US005082168A

United States Patent [19]

Gaetano

[11] Patent Number: 5,082,168

[45] Date of Patent: Jan. 21, 1992

[54] COMPARTMENTED ARTICLE RECEIVING DEVICE FOR HOLDING PHOTOGRAPHIC PROOFS AND NEGATIVES

[75] Inventor: Ralph R. Gaetano, Bethel Park, Pa.

[73] Assignee: Think, Inc., Pittsburgh, Pa.

[21] Appl. No.: 578,737

[22] Filed: Sep. 6, 1990

[51] Int. Cl.[5] ..... B65D 27/08

[52] U.S. Cl. ..... 229/72; 206/455; 206/491; 493/243; 493/920

[58] Field of Search ..... 206/449, 455, 491; 150/132; 229/68 R, 70, 72, 73, 1.5 R; 493/243, 267, 920

[56] References Cited

U.S. PATENT DOCUMENTS

| | | | |
|---|---|---|---|
| 601,922 | 4/1898 | Wieland | 229/72 X |
| 901,357 | 10/1908 | Lewis | 206/449 X |
| 1,269,247 | 6/1918 | Aslin | 150/132 |
| 1,316,615 | 9/1919 | Hocking | 206/449 X |
| 1,404,193 | 1/1922 | Dietsche, Jr. | 229/72 |
| 1,515,901 | 11/1924 | Helmquest | 229/1.5 R X |
| 1,774,215 | 8/1930 | Weinthrop | 229/72 |
| 2,026,140 | 12/1935 | Poppe | 229/72 |
| 2,378,020 | 6/1945 | Longworthy | 229/72 |
| 3,334,677 | 8/1967 | Toomey | 206/455 X |
| 3,360,027 | 12/1967 | Price | 229/72 X |
| 3,758,136 | 9/1973 | Guyer | 229/1.5 R X |
| 3,999,701 | 12/1976 | Ward | 150/132 X |
| 4,047,661 | 9/1977 | Klein | 229/72 X |

*Primary Examiner*—Bryon P. Gehman
*Attorney, Agent, or Firm*—Stanley J. Price, Jr.

[57] ABSTRACT

An article receiving apparatus and a method of forming an article receiving apparatus having an intermediate panel connected by a fold to a lateral panel on one side and by a fold in the opposite direction to the first fold to a panel connected on the opposite side. A bottom flap is formed by folding a portion of the three panels transversely to the longitudinal axes of the folds. The bottom flap is glued to one of the lateral panels. A pocket is formed between one lateral panel and the intermediate panel which opens at a first side of the article receiving device and the top portion of the article receiving device. Another pocket is formed between the other lateral panel and the intermediate panel, which opens on a second side of the article receiving device and at the top portion of the article receiving device.

6 Claims, 2 Drawing Sheets

COMPARTMENTED ARTICLE RECEIVING DEVICE FOR HOLDING PHOTOGRAPHIC PROOFS AND NEGATIVES

BACKGROUND OF THE INVENTION

1. Field of the Invention

This invention relates to an article receiving device, and more particulary, to an article receiving device for use in conjunction with a film proof and a film negative. The article receiving device is formed of an integral piece of glassine paper or other suitable material and is folded into three equal portions. The first equal portion is folded over the second equal portion. The third equal portion is folded under the second equal portion. A bottom flap is formed by folding a portion of the three equal portions transversely to the longitudinal axes of the folds in the three equal portions. The bottom flap is glued onto either the first equal portion or the third equal portion.

2. Description of the Prior Art

In envelope and paper bag making, it is well known to provide a piece of material for the formation of envelopes and paper bags. The material is folded and cut to form the appropriate article.

U.S. Pat. No. 601,922 discloses a pocketbook made by folding a rectangular integral sheet of durable paper transversely to its longitudinal axis and folding the durable paper again along its longitudinal axis.

U.S. Pat. No. 1,269,247 discloses a wallet case for dollar bills or similar articles. The wallet case is formed by folding a first third portion over a second third portion and then folding a final third portion over the second third portion opposite the first third portion.

U.S. Pat. No. 1,404,193 discloses a multiple pocket envelope integrally formed from a single piece of paper. The envelope has a body portion, a top flap, bottom flap and two side flaps. One side flap is folded accordian style into six panels with arcuate cutout portions at its top margin of increasing height. The accordian style panel is folded onto the body portion to form multiple pockets and is secured by the top flap, bottom flap and opposite side flap.

U.S. Pat. No. 1,774,215 discloses a display folder. The folder has a main body flap with two side flaps and a bottom flap. One side flap has the same rectangular shape as the body flap. The other side flap is cut at an angle. The base of the angle of the cut on the side flap runs from the top of the main body flap to a point along the outer side of the cut side flap. The cut side flap is folded over the main body flap, and the bottom flap is folded up over it. The opposite side panel is then folded over the main body portion and the cut flap to form a cover.

U.S. Pat. No. 2,026,140 discloses a compartment bag and the process of making it. A continuous web of paper is unrolled onto a machine and conveyed by means of a conveyor belt where it is folded over itself and pasted to form a tube. The tube is then cut, and one end of the tube is folded over and pasted to form a bottom flap.

U.S. Pat. No. 3,360,027 discloses a ticket and money holder. The ticket and money holder is formed by folding two rectangular panels into equal halves. One panel is inserted into the other panel. The panels are sewn together on three sides, and on the outer edges of the top portion. The outer panels have arcuate cutouts at the top edge. In another embodiment of the invention, a rectangular panel is folded into four equal sections, and sewn together on three sides, and on the outer edges of the top side. The top side is cut at an angle on both outside panels from one top edge to a point on a lateral side of the outside panels.

U S. Pat. No. 3,999,701 discloses a currency holding folder for use with a money counting machine. The folder is formed of three portions, two portions being equal and one portion having a shorter width than the other two portions. The portion with the shorter width is lateral to the equal portion as is the other equal portion. The lateral equal portion is folded along its longitudinal axis over the middle equal portion, and the flap with the shorter width is folded along its longitudinal axis over the lateral equal portion. The lateral equal portion and a part of the middle equal portion have a cutout at one corner opposite the side of the envelope on which the flap with the shorter width is located to enable the visual inspection of the contents of the envelope.

U.S. Pat. No. 4,151,985 discloses the use of a constant tension recoil spring coupled to a shiftable web feeder chute. The recoil spring prevents sagging of the web due to gravity and the consequent failure of the spirals on a spiral-type zigzag web folding unit to engage the fed sections.

U.S. Pat. No. 4,557,712 discloses an apparatus for laying web sections into a folded "Z"-shape form. The apparatus consists of two conveyor belts which run in the same direction. One conveyor belt is above the second conveyor belt. The web is fed from the top conveyor belt to the bottom conveyor belt where it is clamped by a piston operated clamp. The web is then cut and pushed into a loop by another piston. The cut loop of web is moved transversely to another conveyor system.

Although the prior art includes various types of envelopes and bags, there is a need for an improved article receiving device having the capacity to provide separate pockets for photographic proofs and photographic negatives.

SUMMARY OF THE INVENTION

In accordance with the present invention, there is provided a process for forming an article receiving device for use with photographic proofs and photographic negatives. A sheet of material is folded into three equal portions along its longitudinal axis. Thus there is formed a medial portion, and a first and second lateral portion. The first lateral portion is folded over the medial portion, and the second lateral portion is folded under the medial portion. A bottom flap is formed by folding over part of the three equal portions transversely to the longitudinal axis of the fold lines in the sheet of material. The end flap is glued into place with any suitable glue. The resulting article receiving device has two flaps separated by the intermediate flap. Two pockets are formed, one between each lateral flap and the intermediate flap which open on opposite sides of the article receiving device and on the top side of the article receiving device.

The present invention also includes the article receiving device so formed which comprises a front flap folded over an intermediate flap. The envelope of the present invention also has a back flap folded under the intermediate flap. The intermediate flap is between the front and the back flaps. Since the envelope is formed of one integral piece, the flaps open on opposite sides. A bottom flap consists of a portion of the front, intermediate and back flaps adjacent the bottom edge of the material folded transversely to the longitudinal axes of the fold lines and glued to the front or back flap. Thus, the envelope forms two openings which both open on the top edge, which is opposite the bottom flap, and on opposite sides of the article receiving device.

In another embodiment of the present invention, the front and back flaps have on the top edge, which is opposite the bottom flap, on the article receiving device a cutout portion parallel to the top edge of the intermediate flap and slightly below the level of the top edge of the intermediate flap, to enable the user of the envelope to more easily remove the contents thereof.

Accordingly, the principal object of the present invention is to provide an article receiving device with two separate pockets enabling the user to place a photographic proof and a photographic negative in separate pockets of the same article receiving device.

These and other objects of the present invention will be more completely disclosed and described in the following specification, the accompanying drawings and the appended claims.

DESCRIPTION OF PREFERRED EMBODIMENTS

Figure 1:
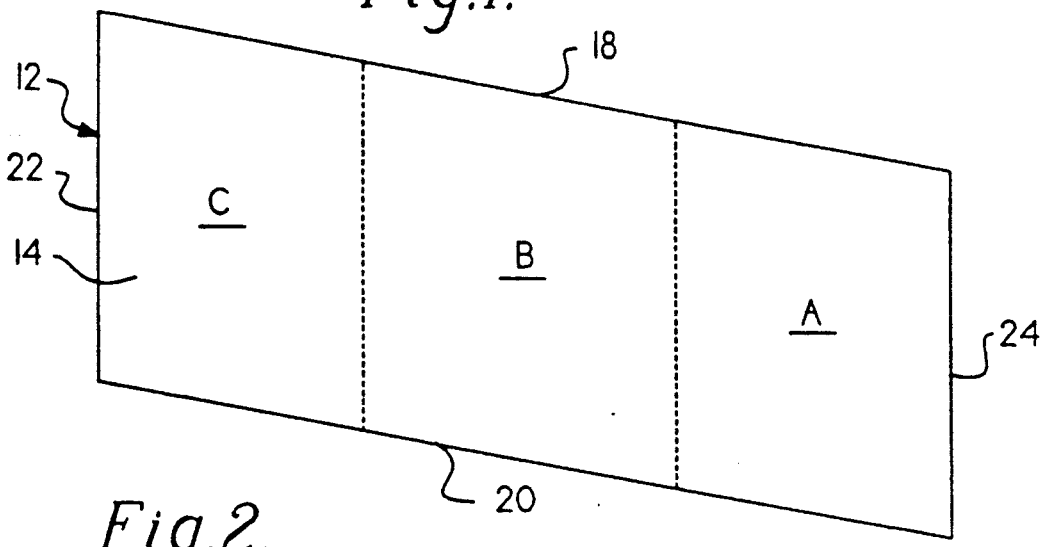
FIG. 1 is a top plan view of a sheet of material with the fold lines indicated by dotted lines.
Figure 2:
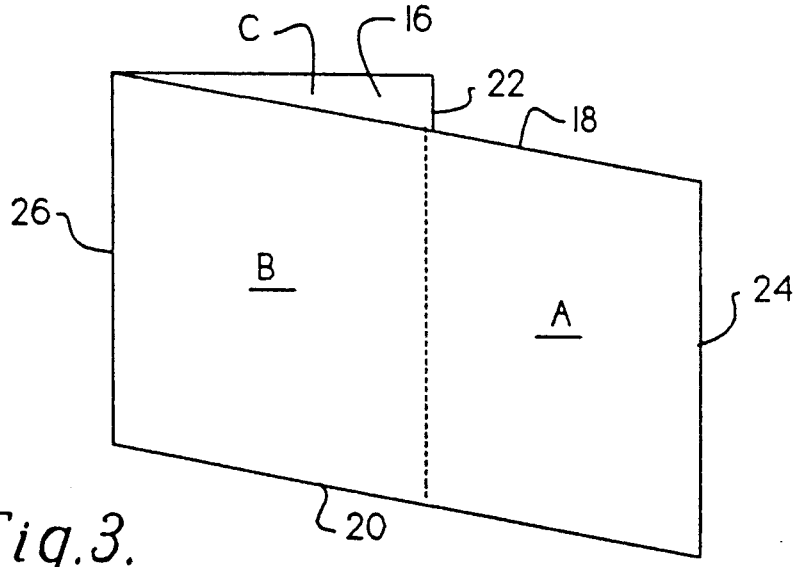
FIG. 2 is a top plan view of the sheet of material indicating the fold line and showing the first fold.
Figure 3:
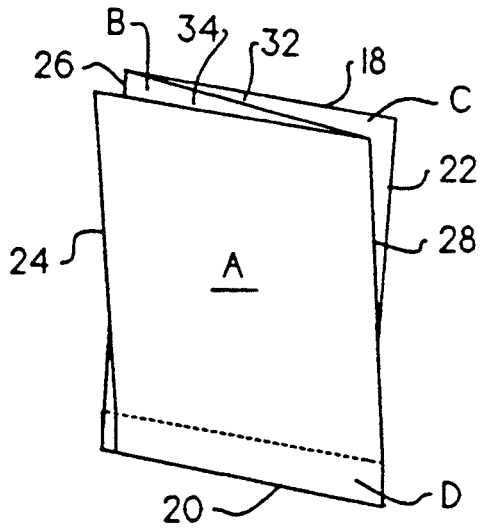
FIG. 3 is a top plan view showing the dotted fold line of the bottom flap and indicating the first and second folds.
Figure 4:
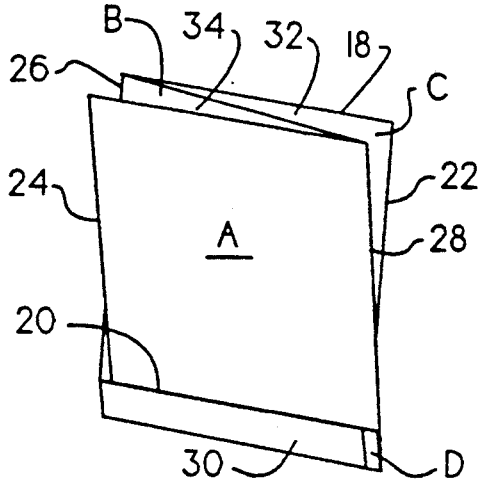
FIG. 4 is a side elevation view of the sheet of material after it has been folded into the article receiving device.
Figure 5:
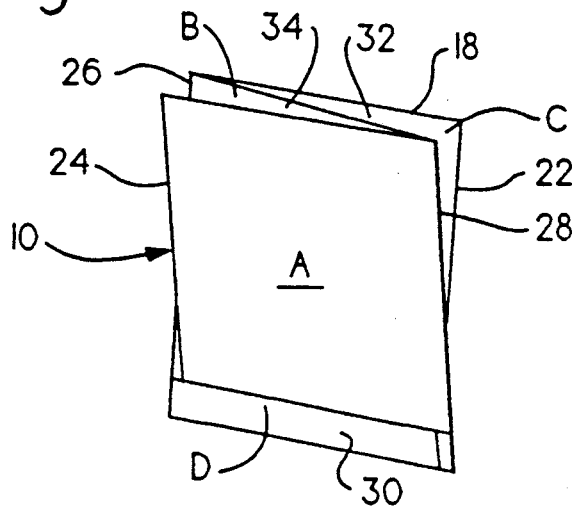
FIG. 5 is another side elevation view of the present invention.
Figure 6:
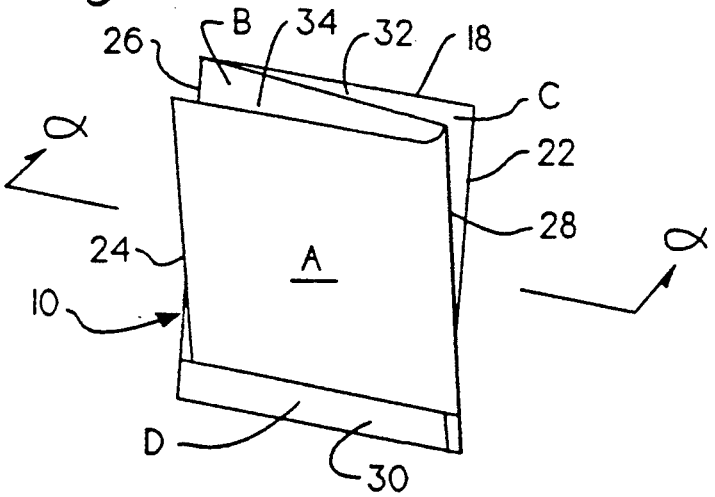
FIG. 6 is another side elevation of the present invention with one outside flap having a cutout portion.

Referring to the drawings, and particularly to FIGS. 5 and 6, there is illustrated an article receiving device generally designated by the numeral 10 for use in receiving and separating photographic negatives and photographic proofs.

Referring to FIGS. 5 and 6, article receiving device 10 consists of a panel A joined by fold 28 to panel B. Panel B is joined to panel C by fold 26. A bottom flap D which is composed of a portion of panel A, panel B, and panel C, is attached to panel A, panel B, and panel C by fold 30. Bottom flap D is glued to panel A with any suitable glue. With this arrangement a first pocket 32 and a second pocket 34 are formed for the article receiving device 10.

Figure 7:
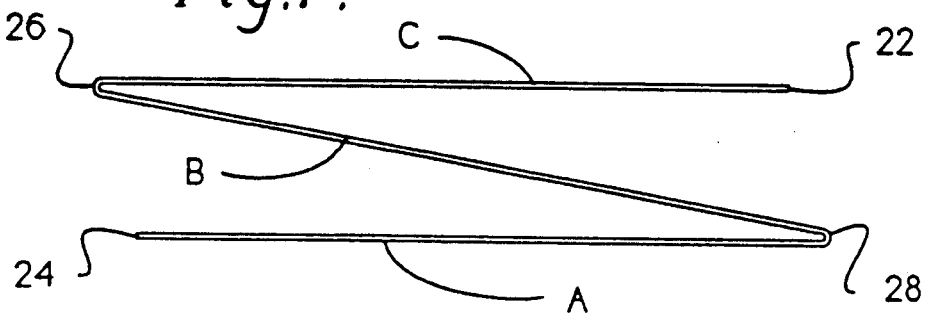
FIG. 7 is a cross section of the present invention taken along line alpha-alpha in FIG. 6.

Fold 28, fold 30, panel A, and panel B form the second pocket 34 which is best illustrated in FIGS. 5, 6 and 7. As can be seen in FIGS. 5 and 6, second pocket 34 opens at top edge 18 which is opposite the third fold 30. Second pocket 34 also opens on second side edge 24 which is opposite the second fold 28.

First pocket 32 is formed between panel C and panel B and is defined by the first fold 26 and the third fold 30. First pocket 32 opens at the top edge 18 which is opposite from the third fold 30. First pocket 32 also opens on the first side edge 22 which is opposite the first fold 26.

Thus it can be seen from FIGS. 5, 6, and 7 that article receiving device 10 has two pockets. The first pocket 32 is formed between panel C and panel B and is bounded by first fold 26 and third fold 30. Second pocket 34 is formed between panel A and panel B and is bounded by second fold 28 and third fold 30. First pocket 32 opens on first side edge 22, and second pocket 34 opens on second side edge 24. Both first pocket 32 and second pocket 34 open at top edge 18.

The present invention also includes the process of making the article receiving device 10. Article receiving device 10 is made from a sheet of material 12 having a front face 14, a rear face 16, a top edge 18, a bottom edge 20, a first side edge 22, and a second side edge 24 as shown in FIGS. 1, 2, 3 and 4. The sheet of material 12 is preferably glassine paper. Panel C is formed by folding approximately one-third of the sheet of material 12 toward the rearward face 16 of the sheet of material 12. Thus fold 26 is formed, which is parallel to the first side edge 22. A second panel A is formed by folding another approximate one-third of the sheet of material 12 toward the front face 14 of the sheet of material 12. The fold 28 formed by folding panel A onto the front face 16 of the material 12 is parallel to fold 26.

A third fold 30 is formed by folding over a portion of the bottom edge 20 of panel A, panel B, and panel C transversely to the longitudinal axis of fold 26 and fold 28.

Thus, an article receiving device 10 is formed having two pockets. The first pocket 32 is formed between panel C and panel B. First pocket 32 is bounded by the first fold 26, and the bottom fold 30. First pocket 32 opens at the top edge 18 and at the first side edge 22.

A second pocket 34 is formed between panel A and panel B. Second pocket 34 is bounded by the second fold 28 and the third fold 30. Second pocket 34 opens at top edge 18 and second side edge 24.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated or described.

I claim:

1. An article receiving device comprising, a portion of material having a generally rectangular configuration, said material having a top edge, a bottom edge, a first side edge, a second side edge, a first face and second face, a front flap portion formed by a first fold of said material adjacent said first side edge, said first fold of said material placing said front flap portion over said first face of said material, a back flap portion formed by a second fold of said material adjacent said second side edge, said second fold of said material placing said back flap portion over said second face of said material, an intermediate flap portion between said first fold and said second fold, a bottom flap portion formed by a third fold of said material adjacent said bottom edge, said bottom edge of said folded material including a portion of said front flap portion adjacent said bottom edge of said material, a portion of said intermediate flap portion adjacent said bottom edge of said material, and a portion of said back portion adjacent said bottom edge of said material, said third fold of said material placing said bottom flap portion over said front flap portion, a first pocket formed between said front flap portion, said intermediate flap portion, said first fold and said third fold, said first pocket having an opening extending across said top edge of said material and downwardly along said first side edge of said material, a second pocket formed between said back flap portion, said intermediate flap portion, said second fold and said third fold, and said second pocket having an opening extending across said top edge of said material and downwardly along said second side edge of said material.

2. The article receiving device as in claim 1 wherein, said front flap portion having a front width, said front width being the distance between said first side edge and said first fold, said intermediate flap portion having an intermediate width, said intermediate width being the distance between said first fold and said second fold, and said front width of said front flap portion being less than said intermediate width of said intermediate flap portion.

3. The article receiving device as in claim 2 wherein, said back flap portion having a back width, said back width being the distance between said second fold and said second side edge, said back width of said back flap portion being less than said intermediate width of said intermediate flap portion.

4. The article receiving device as in claim 3 wherein, said top edge of said material forms a top edge of said front flap portion, a top edge of said intermediate flap portion and a top edge of said back flap portion, said top edge of said front flap portion being generally parallel to and spaced from said top edge of said intermediate flap portion and said top edge of said front flap portion being nearer said third fold than said top edge of said intermediate flap portion.

5. The article receiving device as in claim 4 wherein, said top edge of said back flap portion being generally parallel to and spaced from said top edge of said intermediate flap portion and said top edge of said back flap portion being nearer said third fold than said top edge of said intermediate flap portion.

6. A method of forming an article receiving device comprises, folding approximately one-third of a generally rectangular sheet of material having a top edge, a bottom edge, a first side edge, a second side edge, a first face and a second face, onto said first face adjacent said first side edge to form a first outer panel and a first fold, folding another approximate one-third of said material adjacent said second side edge onto said second face to form a second outer panel, a second fold, and an intermediate panel between said first fold and said second fold, folding a portion of said bottom edge of the twice folded material which includes a portion of said first outer panel adjacent said bottom edge of said material, a portion of said second outer panel adjacent said bottom edge of said material, and a portion of said intermediate panel adjacent said bottom edge of said material, generally parallel to said bottom edge of said material, fastening said portion of said bottom edge of said twice folded material to one of said outer panels to form a bottom flap and a third fold, forming a first pocket between said first outer panel and said intermediate panel, bounding said first pocket by said first fold and the folded bottom edge, forming a second pocket between said second outer panel and said intermediate panel, and bounding said second pocket by said second fold and the folded bottom edge.

* * * * *